US007911141B2

(12) United States Patent
Min

(10) Patent No.: US 7,911,141 B2
(45) Date of Patent: Mar. 22, 2011

(54) PLASMA DISPLAY PANEL HAVING DIELECTRIC LAYER PROVIDING IMPROVED DISCHARGE EFFICIENCY

(75) Inventor: Woong Kee Min, Yongin-si (KR)

(73) Assignee: LG Electronics Inc., Seoul (KR)

( * ) Notice: Subject to any disclaimer, the term of this patent is extended or adjusted under 35 U.S.C. 154(b) by 288 days.

(21) Appl. No.: 12/195,664

(22) Filed: Aug. 21, 2008

(65) Prior Publication Data

US 2009/0051289 A1 Feb. 26, 2009

(30) Foreign Application Priority Data

Aug. 21, 2007 (KR) ..... 10-2007-0084022

(51) Int. Cl.
*H01J 17/49* (2006.01)
*H01J 17/00* (2006.01)

(52) U.S. Cl. ..... 313/586; 313/581; 313/582; 313/583; 313/584; 313/585; 313/587

(58) Field of Classification Search ..... None
See application file for complete search history.

(56) References Cited

U.S. PATENT DOCUMENTS

| | | | | |
|---|---|---|---|---|
| 6,255,780 | B1 * | 7/2001 | Komaki et al. | 313/586 |
| 6,525,470 | B1 * | 2/2003 | Amemiya | 313/586 |
| 7,002,295 | B2 * | 2/2006 | Kojima et al. | 313/582 |
| 7,759,868 | B2 * | 7/2010 | Naoi et al. | 313/586 |
| 2007/0057871 | A1 * | 3/2007 | Sato et al. | 345/67 |
| 2007/0152593 | A1 * | 7/2007 | Kim et al. | 313/587 |

FOREIGN PATENT DOCUMENTS

| | | |
|---|---|---|
| JP | 2005332602 | 12/2005 |
| KR | 10-2004-0017798 | 2/2004 |
| KR | 1020060056869 | 5/2006 |
| KR | 10-0603363 | 7/2006 |
| KR | 1020070029093 | 3/2007 |

OTHER PUBLICATIONS

English machine translation of JP 2005-332602 (Hayashi et al).*
Korea Office Action dated Aug. 29, 2008.
Korean Office Action issued in KR Application No. 10-2007-0084022 dated Jun. 8, 2010.

* cited by examiner

*Primary Examiner* — Nimeshkumar D Patel
*Assistant Examiner* — Natalie K Walford
(74) *Attorney, Agent, or Firm* — KED & Associates, LLP

(57) ABSTRACT

A plasma display panel that achieves improved discharge efficiency and reduced discharge voltage is provided. The plasma display panel includes a substrate, a sustain electrode located on the substrate, a first dielectric layer located on the substrate formed with the sustain electrode, and a second dielectric layer located on the first dielectric layer and having a larger dielectric constant than a dielectric constant of the first dielectric layer.

13 Claims, 5 Drawing Sheets

PLASMA DISPLAY PANEL HAVING DIELECTRIC LAYER PROVIDING IMPROVED DISCHARGE EFFICIENCY

This application claims the benefit of the Korean Patent Application No. 10-2007-0084022, filed in Korea on Aug. 21, 2007, which is hereby incorporated by reference as if fully set forth herein.

BACKGROUND

1. Field

This relates to a plasma display panel, and more particularly, to a plasma display panel capable of achieving improved discharge efficiency and reduced discharge voltage.

2. Background

Generally, a plasma display panel (hereinafter, referred to as a "PDP") is a luminous device that displays an image using an electric discharge within a plurality of discharge cells. Such a PDP does not require that each cell be provided with an active device and therefore, such a PDP may have a relatively large-size screen produced by a simplified manufacturing process, an easily increased screen size, and rapid response time.

Referring to FIG. 1, a PDP is generally configured in such a manner that an upper panel 10 and a lower panel 20 are stacked one above another so that they face each other. The upper panel 10 includes a pair of sustain electrodes 12 arranged at an inner surface of a transparent substrate 11. Normally, the sustain electrodes 12 are divided into a transparent electrode and a bus electrode. The sustain electrodes 12 are coated with a dielectric layer 13 for AC driving. A protective film 14 is formed at a surface of the dielectric layer 13.

The lower panel 20 includes address electrodes 22 arranged on an inner surface of a lower substrate 21, and a dielectric layer 23 is formed over the address electrodes 22. A stripe type or well-type barrier rib 24 is formed over the dielectric layer 23 to partition the space between the upper panel 10 and the lower panel 20 into discharge cells 25. Red, blue, and green fluorescent layers 26 for display of different colors are coated over the discharge cell space partitioned by the barrier rib 24 to define sub-pixels. A discharge cell 25 is partitioned, on a sub-pixel basis, by the barrier rib 24, and is filled with a discharge gas. One pixel includes three sub-pixels.

The upper dielectric layer 13 covering the sustain electrodes 12 may be made of a material having a uniform specific dielectric constant. In this case, if the upper dielectric layer 13 is made of a material having a relatively low specific dielectric constant, it may cause an increase in discharge voltage upon driving of the PDP.

Moreover, if the upper dielectric layer 13 is made of the relatively low specific dielectric constant material, a capacitance between the sustain electrodes 12 may be increased, resulting in increased unavailable electric power.

SUMMARY OF THE INVENTION

Accordingly, embodiments as broadly described herein are directed to a plasma display panel that substantially obviates one or more problems due to such limitations and disadvantages.

An object is to provide a plasma display panel in which a dielectric layer has an improved configuration to achieve improved discharge efficiency and reduced discharge voltage, resulting in an improvement in reliability and durability of the plasma display panel.

Additional advantages, objects, and features will be set forth in part in the description which follows and in part will become apparent to those having ordinary skill in the art upon examination of the following or may be learned from practice. The objectives and other advantages of embodiments as broadly described herein may be realized and attained by the structure particularly pointed out in the written description and claims hereof as well as the appended drawings.

To achieve these objects and other advantages and in accordance with a first embodiment as broadly described herein, a plasma display panel may include a substrate; a sustain electrode located on the substrate; a first dielectric layer located on the substrate formed with the sustain electrode; and a second dielectric layer located on the first dielectric layer and having a larger dielectric constant than a dielectric constant of the first dielectric layer.

In accordance with a second embodiment as broadly described herein, a plasma display panel may include a substrate; a sustain electrode located on the substrate; and a dielectric layer located on the substrate formed with the sustain electrode and consisting of a plurality of layers having a specific dielectric constant proportional to distance from the substrate.

In accordance with a third embodiment as broadly described herein, a plasma display panel may include a substrate; a sustain electrode located on the substrate; a dielectric layer located on the substrate formed with the sustain electrode; a protective film located on the dielectric layer; and a dielectric particle layer disposed on the protective film.

It is to be understood that both the foregoing general description and the following detailed description are exemplary and explanatory and are intended to provide further explanation of the embodiments as claimed.

BRIEF DESCRIPTION OF THE DRAWINGS

The embodiments will be described in detail with reference to the following drawings in which like reference numerals refer to like elements wherein.

DETAILED DESCRIPTION

Figure 1:
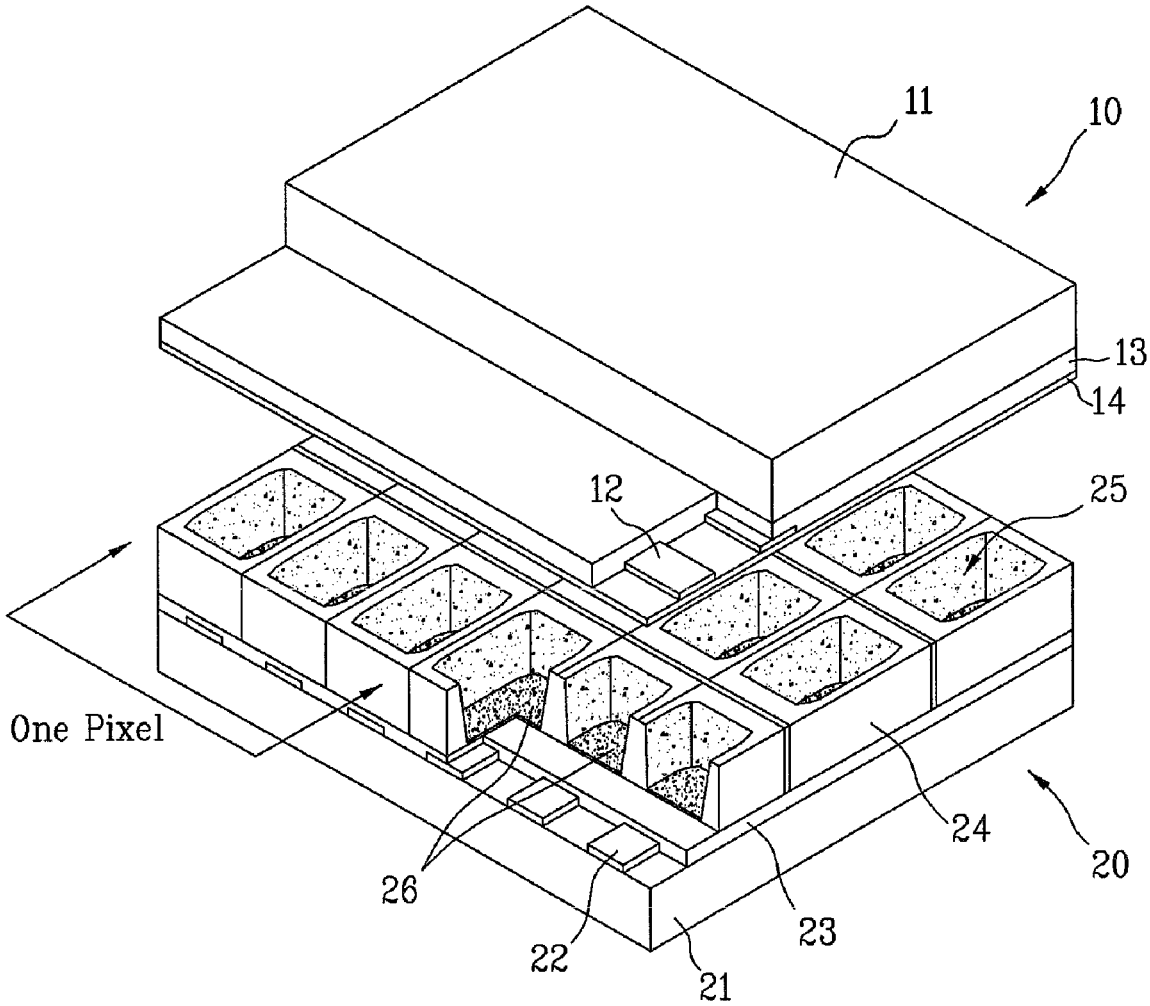
FIG. 1 Related Art
FIG. 1 is a perspective view of an exemplary plasma display panel.

Hereinafter, embodiments will be described in detail with reference to the accompanying drawings.

The same reference numbers will be used throughout the drawings where possible to refer to the same or like parts. In the drawings, dimensions of layers and regions are exaggerated for clarity of description. In addition, the respective embodiments described herein include complementary aggressive embodiments.

It is well understood that, when an element such as a layer, region or substrate is referred to as being "on" another element, it may be directly on the other element or intervening elements may also be present.

It is well understood that, although the terms first, second, etc. may be used herein to describe various elements, components, regions, layers and/or sections, these elements, components, regions, layers and/or sections should not be limited by these terms.

Figure 2:
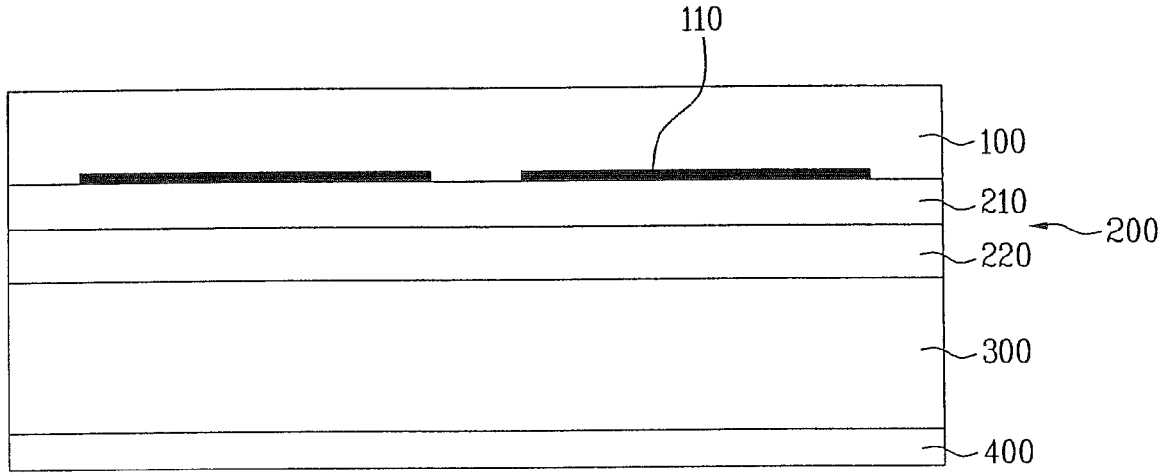
FIG. 2 is a sectional view of a plasma display panel in accordance with an embodiment as broadly described herein.

As shown in FIG. 2, a plasma display panel as embodied and broadly described herein may include a pair of sustain electrodes 110 located in a single discharge space, the sustain electrodes 110 being disposed on a substrate 100.

An upper dielectric layer 200 is located on the substrate 100 such that the sustain electrodes 110 are coated with the dielectric layer 200. The upper dielectric layer 200 has a multi-layer configuration having two or more layers. Specifically, FIG. 2 illustrates a two-layer upper dielectric layer 200 having a first dielectric layer 210 and a second dielectric layer 220.

The specific dielectric constants of the respective dielectric layers 210 and 220 may increase in proportion to distance from the substrate 100 ($\in_1 < \in_2$). The specific dielectric constants of the dielectric layers 210 and 220 may be in a range of, for example, approximately 3 to 20.

In addition, in consideration of an entire thickness of the panel and a discharge space size, the respective dielectric layers 210 and 220 may have a thickness of, for example, approximately 5 μm to 30 μm.

In FIG. 2, a discharge space 300 is defined below the dielectric layer 200 and in turn, a lower dielectric layer 400 is located below the discharge space 300. The panel includes a plurality of discharge spaces 300 partitioned by barrier ribs (not shown). Each discharge space 300 defines a single sub-pixel.

Through the adoption of the above-described multi-layered dielectric layer 200 having a dielectric constant proportional to distance from the substrate 100, the discharge space 300 exhibits a wide electric field distribution therein, thereby achieving a lengthened discharge path and consequently, improved discharge efficiency.

Figure 3:
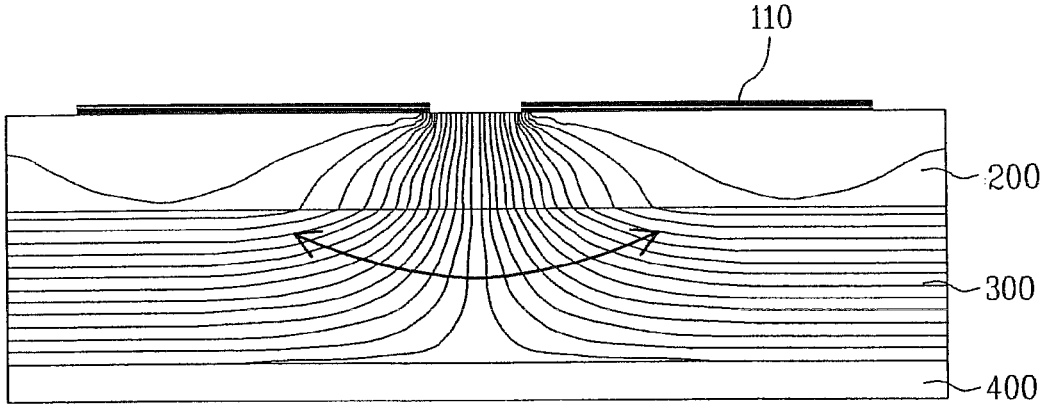
FIGS. 3 and 4 are schematic views illustrating equipotential line distribution based on the embodiment shown in FIG. 2.
Figure 4:
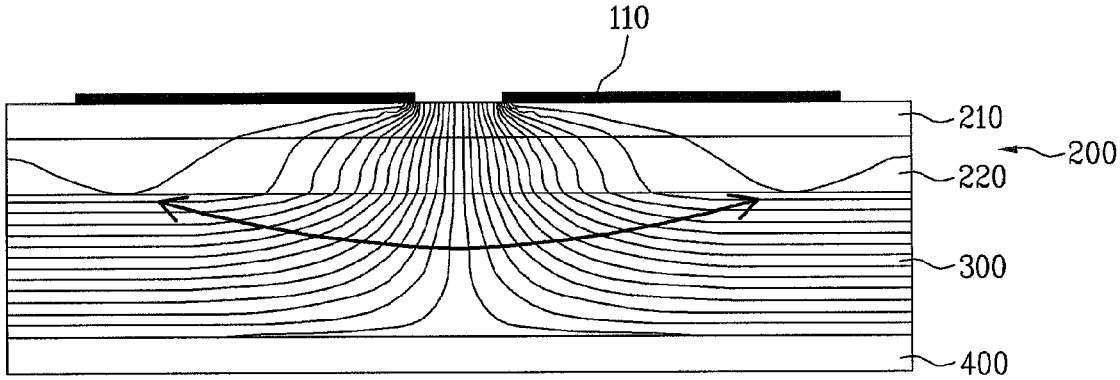

FIGS. 3 and 4 illustrate equipotential distribution in the plasma display panel. More particularly, FIG. 3 illustrates equipotential distribution based on a single-layered dielectric layer, and FIG. 4 illustrates equipotential distribution based on the above-described multi-layered upper dielectric layer 200.

As shown, if a specific dielectric constant of the first dielectric layer 210 is smaller than a specific dielectric constant of the second dielectric layer 220, the discharge space 300 exhibits a wide electric field distribution and thus, can achieve a longer discharge path, as compared to FIG. 3 in which the single-layered dielectric layer is made of a material having a uniform specific dielectric constant.

As will be appreciated from the above description, the length of the discharge path is proportional to a degree of freedom in the occurrence of an actual discharge and consequently, discharge efficiency can be increased.

In addition, in the case where the first dielectric layer 210, which contributes greatly to a capacitance between the sustain electrodes 110, has a smaller specific dielectric constant than a specific dielectric constant of the second dielectric layer 220, this limits any increases in capacitance, resulting in a reduction in electric power consumption.

Alternatively, the above-described multi-layered dielectric layer 200 may include three or more layers. Even in this case, the respective layers of the dielectric layer 200 satisfy the above-described conditions, for example, the specific dielectric constant range of 3 to 20, the thickness range of 5 μm to 30 μm, and an increasing specific dielectric constant with increasing distance from the substrate 100 as set forth above.

Figure 5:
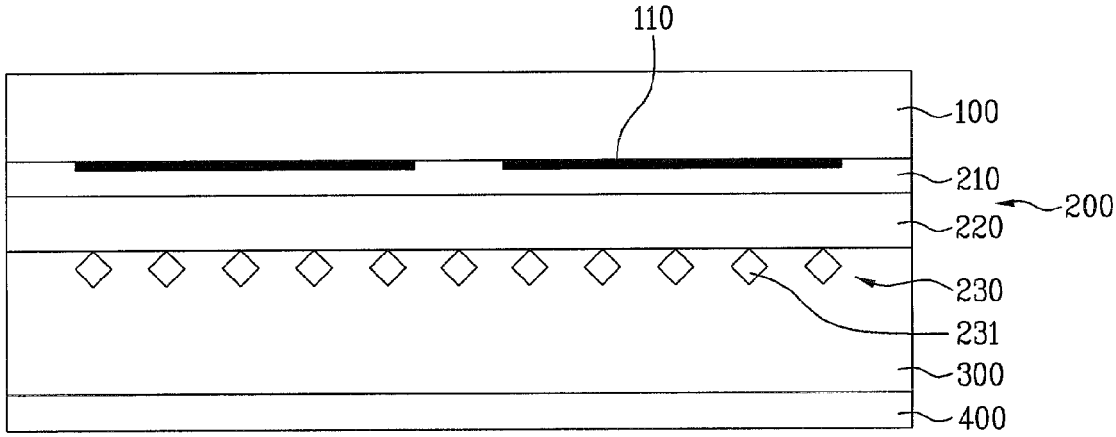
FIG. 5 is a sectional view of a plasma display panel in accordance with another embodiment as broadly described herein.

Specifically, a third dielectric layer 230 may be located on the second dielectric layer 220 of the upper dielectric layer 200. As shown in FIG. 5, the third dielectric layer 230 may include dielectric particles 231. The dielectric particles 231 may have a specific dielectric constant of approximately 3 to 20, and have a spherical shape, an ellipsoidal shape, a polyhedral shape such as, for example, a tetrahedral shape and a hexahedral shape, or other shape as appropriate. At least two or more of the dielectric particles 231 may be located in a single sub-pixel, namely, in the single discharge space 300 of the plasma display panel.

In this case, the dielectric particles 231 may be sized such that a largest diameter portion of each dielectric particle has a diameter of approximately 0.2 μm to 10 μm. In the present embodiment, the term "diameter" may be applied to a polyhedral shape. For example, the diameter may be a longest length portion of the polyhedral dielectric particle, having a length of approximately 0.2 μm to 10 μm.

To form the third dielectric layer 230 including the dielectric particles 231, in one example, a dielectric material may be coated over the second dielectric layer 220 under conditions of a predetermined temperature and pressure, so as to be crystallized on the second dielectric layer 220. In another example, the dielectric particles 231 having a predetermined size may be attached to the second dielectric layer 220. In the latter case, the dielectric particles 231 can remain permanently attached due to electrostatic attraction, without separate attachment means.

Figure 6:
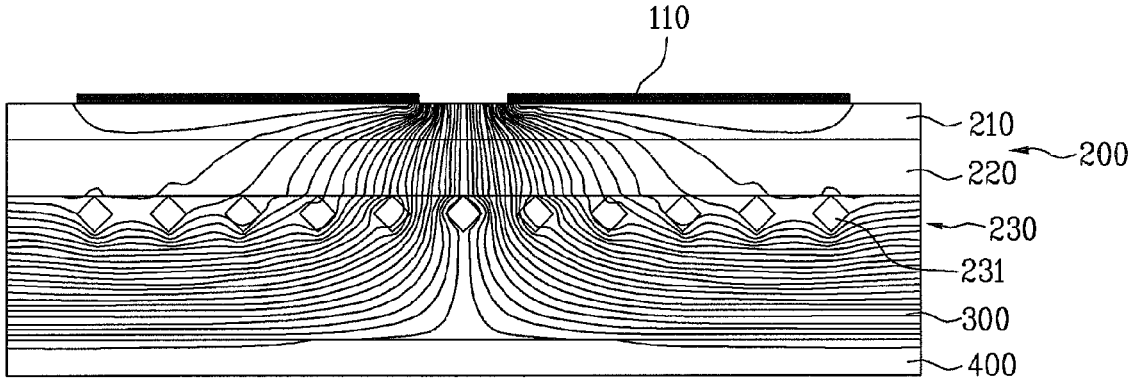
FIG. 6 is a schematic view illustrating equipotential line distribution based on the embodiment shown in FIG. 5.

FIG. 6 illustrates equipotential line distribution based on the embodiment shown in FIG. 5. As can be appreciated from FIG. 6, the presence of the third dielectric layer 230 including the dielectric particles 231 can result in a denser equipotential line distribution.

Such a dense equipotential line distribution has the effect of further reducing a discharge voltage for driving of the plasma display panel.

More particularly, in the case where the upper dielectric layer 200, which has the specific dielectric constant proportional to distance from the substrate 100, includes the dielectric particles 231, increasing an intensity of an electric field between the dielectric particles 231 distributed in the dielectric layer 200 is possible, and this can reduce a discharge voltage.

Figure 7:
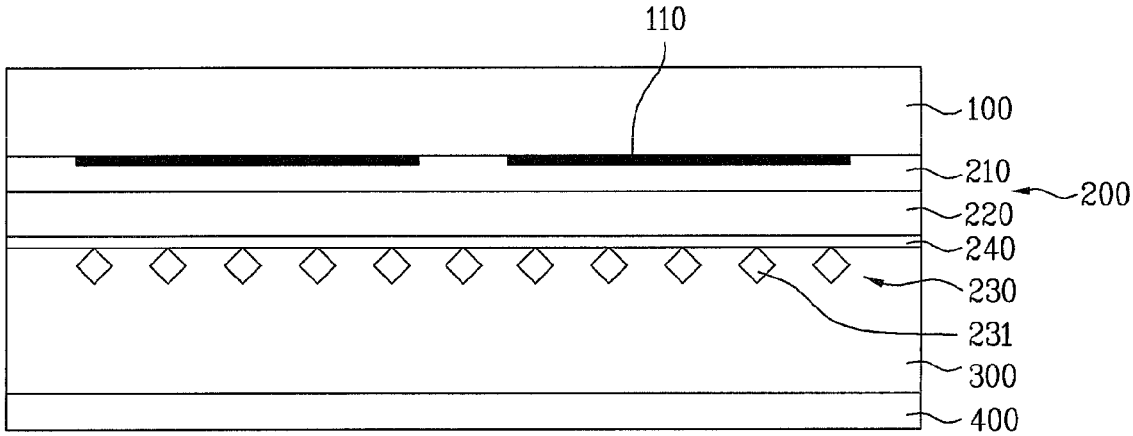
FIG. 7 is a sectional view of plasma display panel in accordance with another embodiment as broadly described herein.

Alternatively, as shown in FIG. 7, in addition to the configuration of FIG. 5, a protective film 240 may be located between the second dielectric layer 220 and the third dielectric layer 230. Alternatively, a fourth dielectric layer may be located between the second dielectric layer 220 and the third dielectric layer 230, in the position of the protective film 240 shown in FIG. 7.

In this case, note that the first dielectric layer 210, the second dielectric layer 220, the third dielectric layer 230, and the fourth dielectric layer may each have a specific dielectric constant established in proportion to its distance from the substrate 100.

Figure 8:
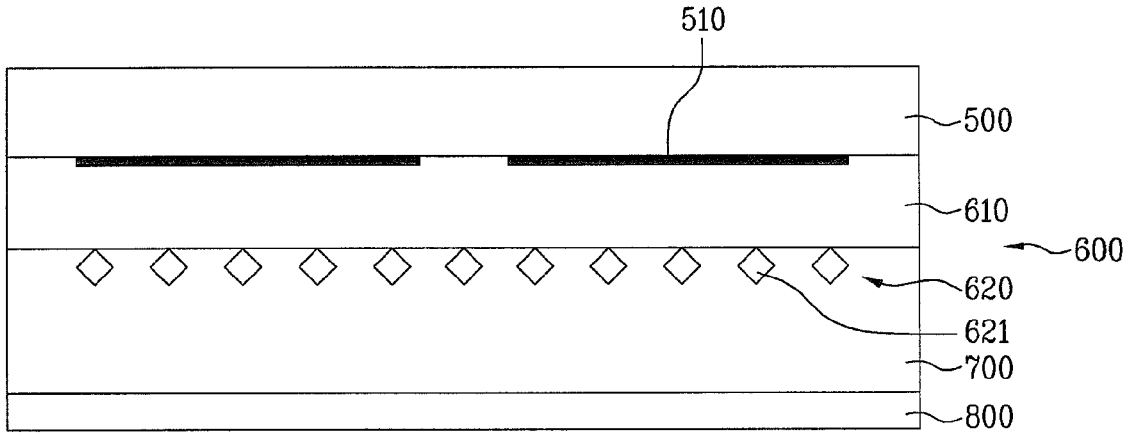
FIGS. 8 and 9 are sectional views of a plasma display panel in accordance with another embodiment as broadly described herein.

As shown in FIG. 8, a plasma display panel according to a second embodiment may include a pair of sustain electrodes 510 located in a single discharge space, the sustain electrodes 510 being disposed on a substrate 500.

An upper dielectric layer 600 is located over the sustain electrodes 510 and the substrate 500. The dielectric layer 600 may include a first dielectric layer 610 coated over the sustain electrodes 510, and a second dielectric layer 620 located on the first dielectric layer 610.

In the present embodiment, the second dielectric layer 620 may be a layer including dielectric particles 621. The dielectric particles 621 may have a specific dielectric constant of approximately 3 to 20, and have a spherical shape, an ellipsoidal shape, a polyhedral shape such as, for example, a tetrahedral shape and a hexahedral shape, or other shape as appropriate.

A discharge space 700 and a lower dielectric layer 800 are located below the second dielectric layer 620. The discharge space 700 is partitioned into a plurality of discharge spaces by barrier ribs (not shown), and each resulting discharge space 700 defines a single sub-pixel.

At least two or more of the dielectric particles 621 may be located in a single sub-pixel, namely, in the single discharge space 700 of the plasma display panel.

The dielectric particles 621 may be sized such that a largest diameter portion of each dielectric particle has a diameter of approximately 0.2 μm to 10 μm.

To form the second dielectric layer 620 including the dielectric particles 621, in one example, a dielectric material may be coated over the first dielectric layer 610 under conditions of a predetermined temperature and pressure, so as to be crystallized on the first dielectric layer 610. In another example, the dielectric particles 621 having a predetermined size may be attached to the first dielectric layer 610 by various methods such as for example electrostatic attraction or bonding. The dielectric particles 621 have the same features as those of the above-described first embodiment.

The second dielectric layer 620 including the dielectric particles 621 can result in a denser equipotential line distribution in the discharge space 700. Such a dense equipotential line distribution has the effect of further reducing a discharge voltage for driving of the plasma display panel.

The second dielectric layer 620 may have a larger specific dielectric constant than a specific dielectric constant of the first dielectric layer 610. In this case, assuming that the specific dielectric constant of the dielectric layer 600 is proportional to distance from the substrate 500, increasing an intensity of an electric field between the dielectric particles 621 distributed in the second dielectric layer 620 is possible, and this can reduce a discharge voltage.

Figure 9:
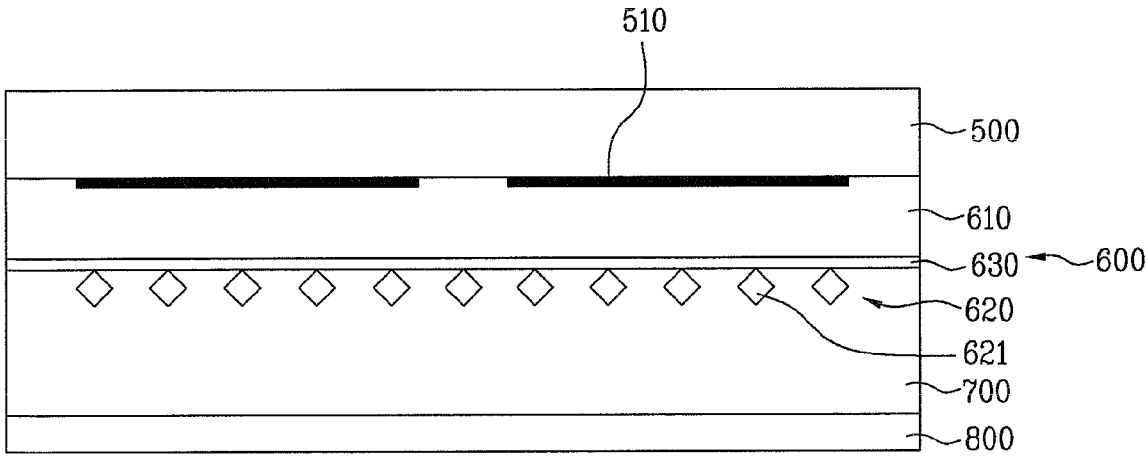

Alternatively, as shown in FIG. 9, in addition to the configuration of FIG. 8, a protective film 630 may be located between the first dielectric layer 610 and the second dielectric layer 620. Alternatively a third dielectric layer may be located between the first dielectric layer 610 and the second dielectric layer 620, in the position occupied by the protective film 630 shown in FIG. 9.

Any reference in this specification to "one embodiment," "an embodiment," "example embodiment," "certain embodiment," "alternative embodiment," etc., means that a particular feature, structure, or characteristic described in connection with the embodiment is included in at least one embodiment as broadly described herein. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various numerous variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A plasma display panel, comprising:
a substrate;
a sustain electrode provided on the substrate;
an upper dielectric layer, comprising:
a first dielectric layer provided on the substrate and the sustain electrode;
a second dielectric layer provided on the first dielectric layer, wherein a dielectric constant of the second dielectric layer is greater than a dielectric constant of the first dielectric layer; and
a third dielectric layer provided on the second dielectric layer, wherein the third dielectric layer includes a plurality of dielectric particles distributed on a surface of the second dielectric layer; and
a lower dielectric layer provided at a predetermined distance from the third dielectric layer so as to define a discharge space therebetween, wherein two or more of the plurality of dielectric particles of the third dielectric layer are provided in the discharge space.

2. The plasma display panel of claim 1, wherein the third dielectric layer has a specific dielectric constant of between 3 and 20.

3. The plasma display panel of claim 1, wherein the plurality of dielectric particles of the third dielectric layer have a spherical shape, an ellipsoidal shape, or a polyhedral shape.

4. The plasma display panel of claim 1, wherein the plurality of dielectric particles of the third dielectric layer are sized such that a largest diameter portion of each dielectric particle is between 0.2 μm and 10 μm.

5. The plasma display panel of claim 1, wherein each of the first dielectric layer and the second dielectric layer has a thickness of between 5 μm and 30 μm.

6. The plasma display panel of claim 1, further comprising a protective film provided between the second dielectric layer and the third dielectric layer.

7. The plasma display panel of claim 1, wherein the upper dielectric layer further comprises a fourth dielectric layer provided between the second dielectric layer and the third dielectric layer.

8. A plasma display panel, comprising:
a substrate;
a sustain electrode provided on the substrate; and
a dielectric layer provided on the substrate and the sustain electrode, wherein the dielectric layer comprises a plurality of layers, wherein each of the plurality of layers has a specific dielectric constant that is proportional its distance from the substrate, and wherein a layer of the plurality of layers that is furthest from the substrate includes a plurality of dielectric particles, wherein two or more of the plurality of dielectric particles of the layer are provided in each discharge space formed between the layer and an adjacent layer of the plurality of layers.

9. The plasma display panel of claim 8, wherein each of the plurality of layers of the dielectric layer has a specific dielectric constant of between 3 and 20.

10. A plasma display panel, comprising:

a substrate;

a sustain electrode provided on the substrate;

a dielectric layer provided on the substrate and the sustain electrode;

a protective film provided on the dielectric layer;

a dielectric particle layer provided on the protective film;

a lower dielectric layer provided at a predetermined interval below the dielectric particle layer; and a plurality of discharge spaces provided in a space firmed between the dielectric particle layer and the lower dielectric layer, wherein two or more dielectric particles of the dielectric particle layer are provided in each of the plurality of discharge spaces.

11. The plasma display panel of claim 10, wherein dielectric particles of the dielectric particle layer are sized such that a largest diameter portion of each dielectric particle is between 0.2 μm and 10 μm.

12. The plasma display panel of claim 10, wherein dielectric particles of the dielectric particle layer have a specific dielectric constant of between 3 and 20.

13. The plasma display panel of claim 10, wherein dielectric particles of the dielectric particle layer have a spherical shape, an ellipsoidal shape, or a polyhedral shape.

* * * * *